US005471685A

United States Patent [19]

Cross

[11] Patent Number: 5,471,685

[45] Date of Patent: Dec. 5, 1995

[54] SUPPORTS FOR HOT TUB SPA COVERS

[75] Inventor: Steven Cross, Surrey, Canada

[73] Assignee: Innovative Inventions Inc., Surrey, Canada

[21] Appl. No.: 350,929

[22] Filed: Dec. 7, 1994

[51] Int. Cl.[6] ..... E04H 4/06

[52] U.S. Cl. ..... 4/500; 4/580; 220/263

[58] Field of Search ..... 4/498, 500, 506, 4/580; 220/263, 329, 331, 744

[56] References Cited

U.S. PATENT DOCUMENTS

| | | | |
|---|---|---|---|
| 1,881,120 | 10/1932 | Fessler et al. | 220/263 |
| 4,234,973 | 11/1980 | Vetter et al. | 4/500 |
| 4,991,238 | 2/1991 | Forrest | 4/498 |
| 5,131,102 | 7/1992 | Salley et al. | 4/498 |
| 5,158,198 | 10/1992 | Melideo | 220/331 X |

*Primary Examiner*—Robert M. Fetsuga
*Attorney, Agent, or Firm*—Graham & James

[57] ABSTRACT

A support for a cover of a hot tub spa has a pair of roller support arms each having a pivotal connection for securing it to the spa. The pivotal connections each comprise an attachment member for mounting on a vertical outer wall of the spa, with a hinge connecting the support arm to its attachment member for pivotation between operative and inoperative positions. In the operative positions, the arms extend horizontally outwardly from the top of the spa. The pivotal connection are separate from one another to allow the spacing between then to be varied as desired, and the rollers support arms each have rollers projecting upwardly from the roller support arms and rotatable about axes extending transversely of the roller support arms to facilitate displacement of the cover onto and from the roller support arms.

3 Claims, 3 Drawing Sheets

SUPPORTS FOR HOT TUB SPA COVERS

BACKGROUND OF THE INVENTION

1. Field of the Invention

The present invention relates to supports for the overs of hot tub spas and, more particularly, to supports intended to be attached to vertical walls of hot tub spas for supporting spa covers when the covers are displaced from their normal positions overlying the hot tubs.

2. Description of the Related Art

In U.S. Pat. No. 4,991,238, issued Feb. 12, 1991 to Steven Forest, there is disclosed a spa cover lift including a movable frame adapted for pivotable attachment to the side of a spa, with one ore more struts for positioning the movable frame between extended and retracted positions and apparatus for receiving a spa cover from the spa and retaining the cover adjacent the moveable frame. The struts are operable to displace the movable frame to an extended position that is substantially co-planar with respect to a top surface of the spa, the struts being operable to displace the moveable frame to a retracted position against the side of the spa for storing the device and the cover in a compact configuration against the side of the spa when the spa is in use.

BRIEF OF THE INVENTION

According to the present invention, there is provided a support for a cover of a hot tub spa which comprises a pair of roller support arms each having a pivotable connection for securing the respective support arm to the hot tub spa. The pivotable connections each comprise an attachment member for mounting on a vertical outer wall of the hot tub spa and a hinge connecting the respective support arm to its attachment member for pivotable movement between an operative position, in which the roller support arm extends horizontally outwardly from the top of the spa, and an inoperative position, in which the roller support arm extends adjacent and parallel to the vertical outer wall of the hot tub spa.

The roller support arms have rollers spaced apart along the roller support arms and projecting upwardly therefrom, when the roller support arms are in their operative positions, the rollers having axes of rotation extending transversely of the roller support arms for facilitating displacement of the cover onto and from the roller support arms.

The pivotable connections are separate from one another so as to allow the spacing between them to be varied as desired.

Due to the fact that the pivotable connections are separate from one another, and can thus have a variable spacing, no horizontally extending framework or other connection is required between the pivotable connections. Therefore, these two pivotable connections can be attached to the vertical wall of the spa at opposite sides of an obstruction which may be located between the two pivotable connections. Also, the spacing between the pivotable connections can be selected so as to avoid obstruction by other objects in the vicinity of the spa.

Thus, the support according to the present invention is more adaptable, by varying the spacing of the attachment members, and easier to use since the rollers make the displacement of the cover easier to effect than is the case with the above-described prior art spa cover lift. Furthermore, the present support is substantially less expensive and more compact then the prior lift.

BRIEF DESCRIPTION OF THE DRAWINGS

Further features, advantages and objects of the present invention will be more readily apparent from the following description thereof when taken in conjunction with the accompanying drawings, in which.

DESCRIPTION OF THE PREFERRED EMBODIMENTS

Figure 1:
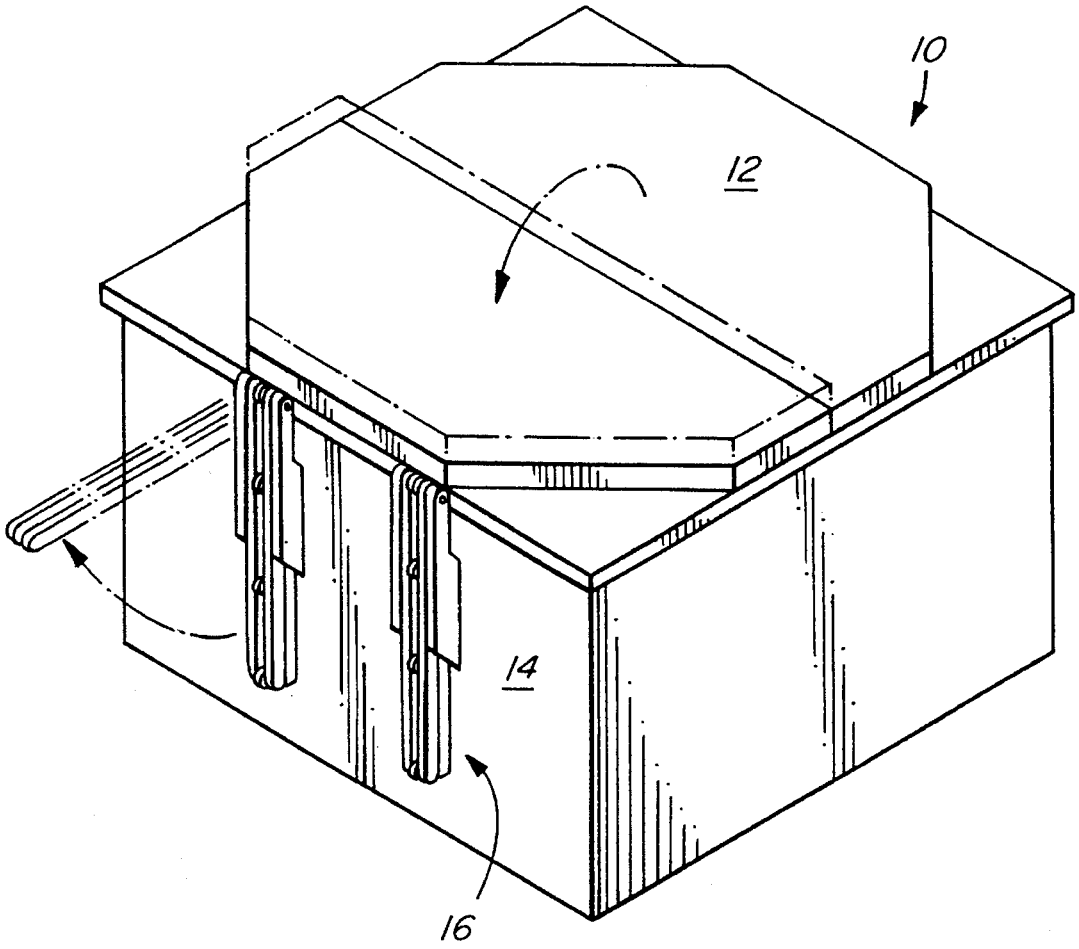
FIG. 1 a diagrammatic view, in perspective, of a hot tub spa having a cover and provided with a cover support according to the present invention.

As shown in FIG. 1, a hot tub spa indicated generally by reference numeral 10 is provided with a cover 12, which can be folded in half, as shown by a chain-dotted line in FIG. 1.

The hot tub spa 10 has a vertical front outer wall 14 on which there is provided a support indicated generally by reference numeral 16 for the cover 12.

Figure 2:
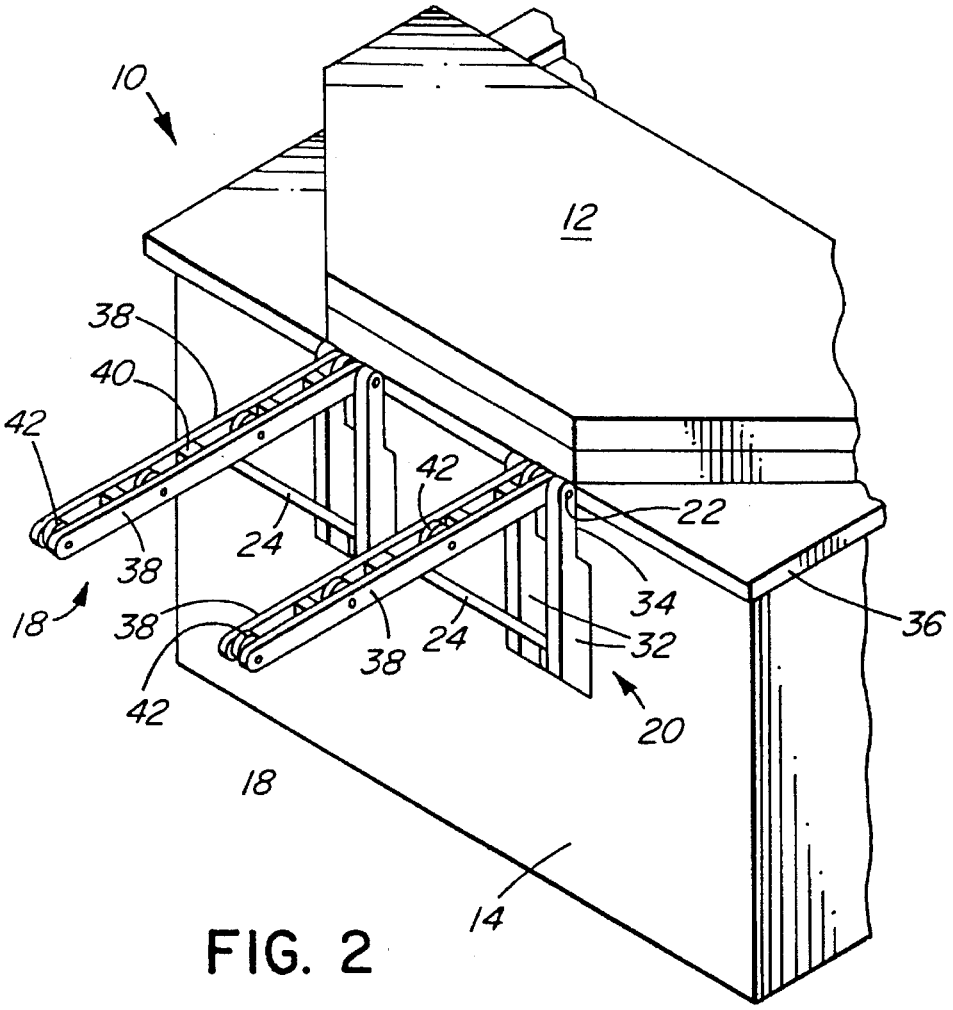
FIG. 2 shows a broken-away view, in perspective, of part of the hot tub spa of FIG. 1, with the support in an operative position.

The support 16 comprises a pair of roller support arms, indicated generally by reference numerals 18 in FIG. 2, each of which is provided with a pivotable connection in the form of an attachment member 20 mounted on the spa front wall 14 and a pivot pin 22 pivotally connecting one end of the roller support arm 18 to its attachment member 20.

The roller support arms 18 are therefore vertically pivotable, about a common horizontal axis of the pivot pins 22, between an operative, horizontal position, in which they are shown in FIG. 2, and a collapsed vertical inoperative position, in which they are shown in FIG. 1.

Figure 3:
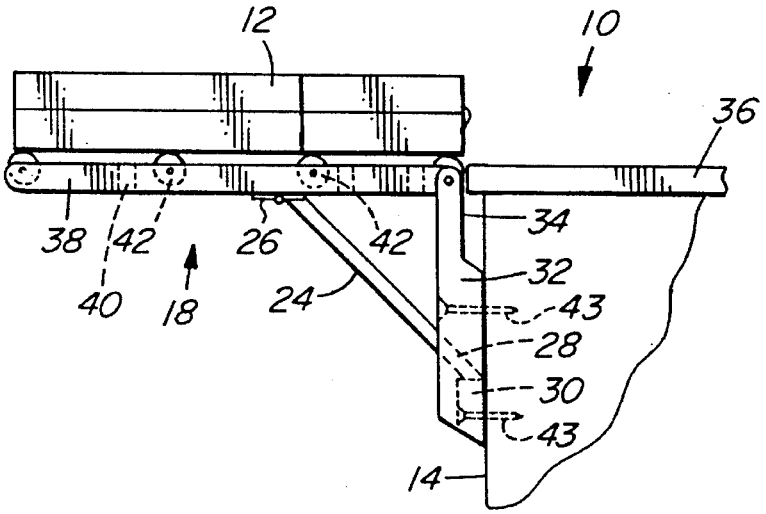
FIG. 3 shows a view inside elevation of the support of FIGS. 1 and 2, with a hot tub spa cover displaced onto the support.

In their operative positions, the roller support arms 18 are supported by means of struts 24, which are pivotally connected to the undersides of the roller support arms 18 by means of hinges, one of which is shown in FIG. 3 and indicated by reference numeral 26.

The struts 24, when in use as illustrated in FIGS. 2 and 3, have lower ends 28 which rest on abutments 30 forming parts of the attachment members 20.

More particularly, the attachment members 28 comprise a pair of vertically extending, horizontally spaced apart, elongate walls 32, which snugly receive and protect the roller support arms 18 therebetween when the roller support arms 18 are in their inoperative positions as shown in FIG. 1, the abutment portions 30 extending between the side walls 32.

The side walls 32 are formed, at their upper ends, with cut-away portions 34 to allow the attachment members 20 to be fitted over a ledge 36 extending around the periphery of the top of the spa 10, the cut-away portions 34 being sufficiently large to accommodate ledges having heights greater than that of the ledge 36 shown in the drawings.

In the present embodiment of the invention, the roller support arms 18 are each formed from a pair of parallel, spaced wooden strips 38, which are held apart by wooden spacers 40. In addition, the arms 18 are also provided with rollers 42, which are spaced apart along the arms 18 and which are freely rotatable in the space between the wooden strips 38 about axes extending transversely of the arms 18.

In use, the arms 18 are erected into their horizontally extending operative positions, in which they are shown in FIG. 2 and 3. In these operative positions, the arms 18 extend substantially flush with the top of the hot tub spa 10, and the rollers 42 project slightly above the tops of the arms 18, as can be seen from FIG. 3. The arms 18 are supported in their operative positions by the struts 24, as described above. The hot tub cover 12 can then be folded in half, as illustrated in FIG. 1, and can be pushed onto the roller support arms 18 and, more particularly, onto the rollers 42. The rollers 42 thus facilitate displacement of the cover 12 from the top of the spa 10 into the position in which it is shown in FIG. 3, and in which it overlays and is supported by the roller support arms 18 at a location offset from the hot tub spa 10.

The attachment members 20 are secured to the spa front wall 14 by screws 43 and, since the attachment members 20 are entirely separate from one another, as shown in the drawings, the spacing between the attachment members can be varied as desired and as may be necessary, for example, so as to avoid obstruction of the cover support 16 by objects projecting from the spa front wall 14 or located in the vicinity of the spa front wall 14.

In the embodiment of the invention shown in FIGS. 1 through 3, the arms 18 are pivotable vertically, about a common horizontal axis, between their operative positions and their inoperative positions, as described above.

Figure 4:
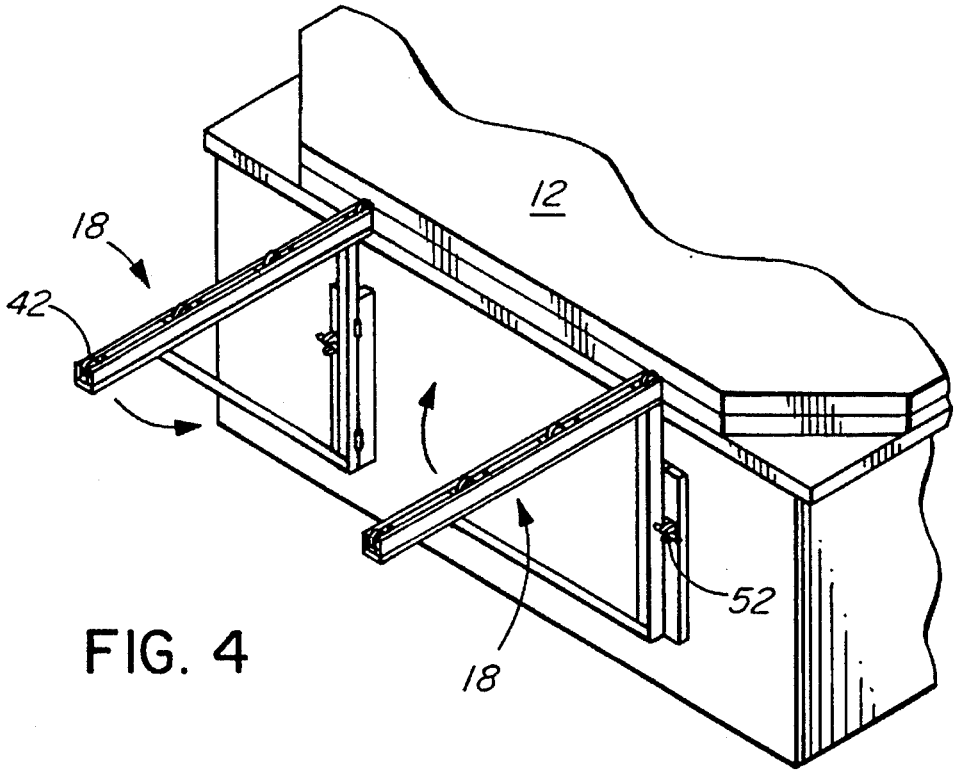
FIG. 4 shows a view corresponding to that of FIG. 2 but of a modified spa cover support.
Figure 5:
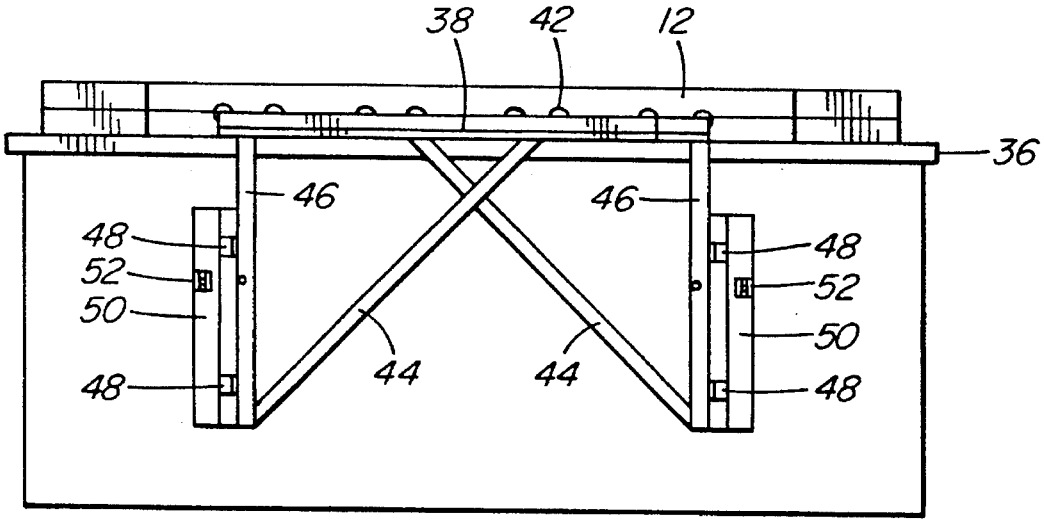
FIG. 5 shows a view in front elevation of the support of FIG. 4 in an inoperative position.

However, in the modified embodiment of the invention illustrated in FIGS. 4 and 5, in which the roller support arms have again been indicated generally be reference numeral 18, the roller support arms 18 are horizontally pivotable about respective vertical axes between their operative and inoperative positions.

More particularly, in the embodiment of FIGS. 4 and 5, the roller support arms 18 are mounted on struts 44 and on vertical elongate supports 46, and the vertical supports 46 are connected by hinges 48, having vertical hinge axes to vertically elongate attachments 50, which are secured by screws to the spa front wall 14. The roller support arms 18 can thus be pivoted horizontally, as indicated by arrows in FIG. 4, into their inoperative positions, in which they are shown in FIG. 5 and in which they extend parallel to one another and to the adjacent spa front wall 14.

When the roller support arms are pivoted upwardly into their operative positions, in which they are shown in FIG. 4, they can be retained in their operative positions by means of catches 52 on the elongate vertical attachment members 50.

As will be apparent to those skilled in the art, various modifications may be made in the above-described embodiments of the present invention within the scope and spirit of the appended claims.

For example, while the roller support arms, struts and attachment members shown in the drawing are made of wood, it is envisaged that they may alternatively be made, for example, of plastic having a cedar finish.

I claim:

1. A support for a cover of a hot tub spa, comprising:

a pair of roller support arms;

said roller support arms each having a pivotal connections for securing the respective roller support arm to the hot tub spa;

each of said pivotal connections comprising an attachment member for mounting on a vertical outer wall of the hot tub spa, and a hinge connecting the respective roller support arm to its attachment member for pivotal movement between an operative position, in which said roller support arm extends horizontally outwardly from the top of the spa, and an inoperative position, in which said roller support arm extends adjacent and parallel to the vertical out wall of the hot tub spa;

said pivotal connections being separate from one another so as to allow the spacing therebetween to be varied as desired; and a plurality of rollers spaced apart along each of said roller support arms and projecting upwardly from said roller support arms, when said roller support arms are in their operative positions, said rollers having axes of rotation extending transversely of said roller support arms for facilitating displacement of the cover onto and from said roller support arms.

2. A support as claimed in claim 1, wherein said hinges allow said roller support arms to pivot vertically between the operative and inoperative positions.

3. A support as claimed in claim 2, wherein said attachment members each comprise a pair of vertical side walls which are spaced apart to receive and protect the respective roller support arm on movement of the latter into its inoperative position.

* * * * *